US009180730B2

(12) United States Patent
Miller

(10) Patent No.: US 9,180,730 B2
(45) Date of Patent: Nov. 10, 2015

(54) TURKEY MOUNT AND PROCESS

(71) Applicant: Dale A. Miller, Battle Creek, MI (US)

(72) Inventor: Dale A. Miller, Battle Creek, MI (US)

( * ) Notice: Subject to any disclaimer, the term of this patent is extended or adjusted under 35 U.S.C. 154(b) by 39 days.

(21) Appl. No.: 14/246,239

(22) Filed: Apr. 7, 2014

(65) Prior Publication Data

US 2015/0283850 A1 Oct. 8, 2015

(51) Int. Cl.
*A47G 25/10* (2006.01)
*B44C 5/06* (2006.01)

(52) U.S. Cl.
CPC ..... *B44C 5/06* (2013.01)

(58) Field of Classification Search
CPC .... B44C 5/05; B44C 5/00; Y10T 428/24008; A47F 5/0807; G09B 25/08
USPC ..... 428/542.4
See application file for complete search history.

(56) References Cited

U.S. PATENT DOCUMENTS

| | | | | |
|---|---|---|---|---|
| 5,015,532 | A * | 5/1991 | Knight | 428/542.4 |
| 5,064,725 | A | 11/1991 | Acker | |
| 5,437,935 | A | 8/1995 | Fredeen | |
| 6,170,185 | B1 * | 1/2001 | Donofrio, Jr. | 40/800 |
| 6,451,393 | B1 | 9/2002 | Ploetz | |
| 6,561,468 | B2 * | 5/2003 | Williamson | 248/146 |
| 6,828,035 | B1 * | 12/2004 | Goettl | 428/542.4 |
| D566,614 | S | 4/2008 | Chase | |
| 8,132,295 | B1 * | 3/2012 | Otis et al. | 16/412 |
| 8,168,305 | B1 | 5/2012 | Peterson | |

* cited by examiner

*Primary Examiner* — Shin Kim

(57) ABSTRACT

A new and novel turkey mount and a process for manufacturing said turkey mount.

12 Claims, 7 Drawing Sheets

TURKEY MOUNT AND PROCESS

BACKGROUND OF THE INVENTION

This invention deals with a new and novel turkey mount and a process for manufacturing said turkey mount.

Mounting of game birds and animals is an old art. The art consists of stuffed animals to display configurations for displaying the animal or fowl. The instant invention deals with the mounting of a turkey tail in a fanned configuration along with a plague representing whatever the designer desires, and a novel mounting of the beard of the turkey. This application also deals with a process for manufacturing the display mount.

A turkey tail fan display device is disclosed in U.S. Pat. No. 8,168,305, that issued to Peterson on May 1, 2012 that consists of an elongated shank having two opposing end and two quill clips located one at each of the two opposing ends of the shank. They have grooves that snap onto the quills near the base of the turkey's outer tail feathers.

There is a game bird feather mount disclosed in U.S. Pat. No. 5,437,935, that issued on Aug. 1, 1995 to Fredeen which includes a frame and mounting block with predetermined rows of holes for receiving the ends of the tail feathers.

Tex Acker, in U.S. Pat. No. 5,064,725 that issued on Nov. 12, 1991 discloses a turkey trophy mounting kit consisting of plaque for display, a cured and dried spread of wild turkey tail fan, and the beard and feet thereof.

None of the prior art references disclose or suggest a mounting system of the instant invention, nor the method by which it is manufactured.

THE INVENTION

What is disclosed and claimed herein is a turkey trophy mounting kit comprising in combination a predetermined configured wooden plaque component, wherein the wood plaque component has a back surface, a front surface, and four openings in the back surface. The openings are on the same horizontal line and spaced apart in a predetermined configuration to accept two separate mounting brackets.

Each of the mounting brackets is copper clad steel rod having two legs and having a diameter from 8 to 12 gauge by Standard Wire Gauge, and from 4 inches to 6 inches in length.

Each mounting bracket has a hooped top end connecting the two legs, the two legs and the hooped top end providing a flat plane, the opposite end of each said leg being configured in an L-shape perpendicular to the plane of the hooped top end and the two legs.

There is a shot shell brass, said shot shell brass having a predetermined inside depth and a notch in its side. There is a wood screw having a length approximately equal to the inside depth of the shot shell brass.

The kit can optionally, also contain at least two, straight, copper coated steel rods of 8 to 12 gauge by standard Wire Gauge.

This invention also contemplates a process for providing a turkey trophy mount prepared from the kit described Supra, the process comprising providing a predetermined size of lumber having a back surface and a front surface and planeing the front and back surfaces. Thereafter, the back and front surfaces are sanded and any edge surfaces that may occur due to a cutting operation are also sanded.

Configuring the lumber into a desired plaque pattern and drilling four openings in the back surface wherein the openings are on the same horizontal line and spaced-apart in a predetermined configuration to accept two separate mounting brackets, wherein the mounting brackets are copper clad steel rods having two legs and having a diameter from 8 to 12 gauge by Standard Wire gauge and from 4 to 6 inches in length.

Each mounting bracket has a hooped top end connected between the two legs, wherein the two legs and the hooped top end provide a flat plane. There is an opposite end of the two legs configured in an L-shape perpendicular to the plane of the hooped top end and the two legs.

Thereafter, installing the mounting brackets in the openings using the two legs, with adhesive, and thereafter, installing a fanned turkey tail in the mounted brackets.

Finally, installing a shot shell brass having a notch in a side thereof using a wood screw inserted through a primer hole 18 in the shot shell brass into the plaque pattern on the front surface, wherein the shot shell brass has been provided with a turkey beard mounted in it.

BRIEF DESCRIPTIONS OF THE DRAWINGS

FIG. 1 is a display of the components of the claimed kit wherein A is a configuration of the lower half of the State of Michigan; B is the upper peninsula of Michigan; C is a pair of mounting brackets; D is the support rods; E shows the top of a shot shell brass, and F is a wood screw.

DETAILED DESCRIPTION OF THE INVENTION

Turning now to FIG. 1, there is shown a full turkey mounting kit of this invention wherein the State of Michigan configuration is shown by way of example. It is contemplated within the scope of this invention to use any configuration desired by the designer or user.

Figure 7:
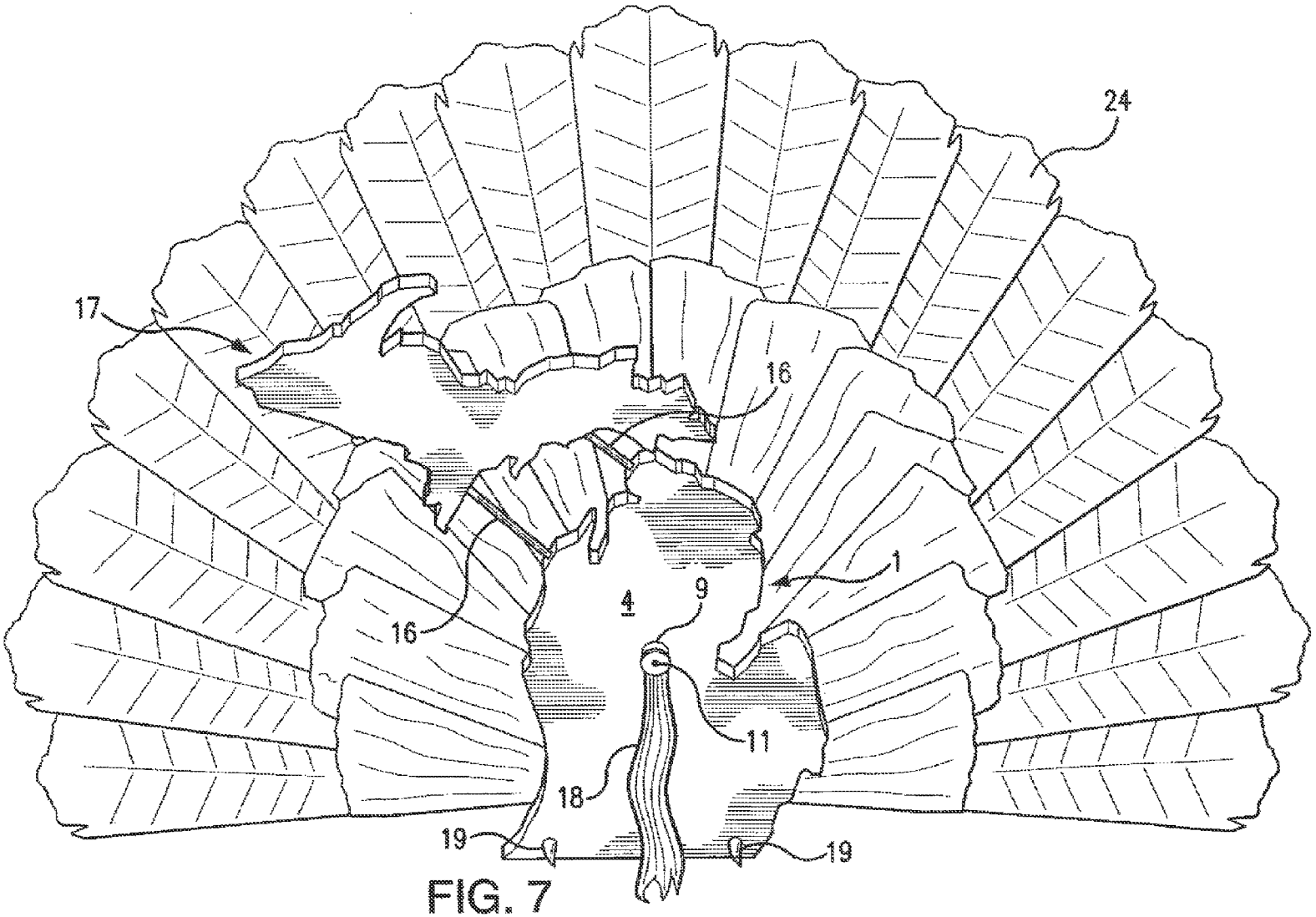
FIG. 7 is a full front view in slight perspective showing a full mount including a fanned turkey tail, beard, and turkey spurs.

There is shown therein, the lower half 1 of the mounting kit which is an outline of the lower peninsula of Michigan. The predetermined configured wooden plaque component has a back surface 3 and a front surface 4 (FIG. 7). What is shown is the back surface 3, in which there are four drilled openings 2 which will be noted are in the same horizontal line (L-L). These openings 2 are used to mount the mounting brackets 5, shown in FIG. 1C.

The mounting brackets 5 are comprised of copper clad steel rods. Each said mounting bracket 3 is a unitary structure consisting of two legs 6 and 6', a hooped top end 7, and an L-Shaped end 8 which is perpendicular to a plane formed by the hooped top end 7 and the two legs 6 and 6'.

The copper clad steel rods have a diameter from 8 to 12 Gauge by Standard Wire Gauge and they are from 4 inches to 6 inches in length, although this length is not critical.

Figure 6A:
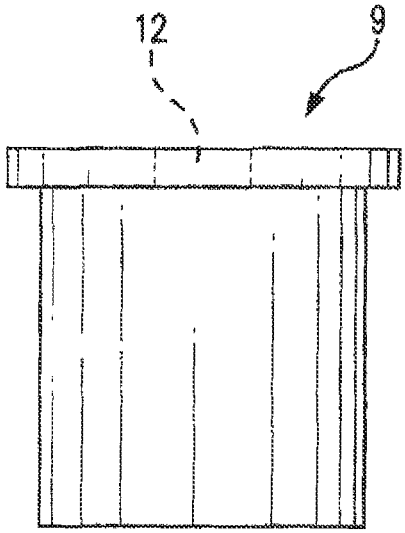
FIG. 6A is a full side view of a shot shell brass component.
Figure 6B:
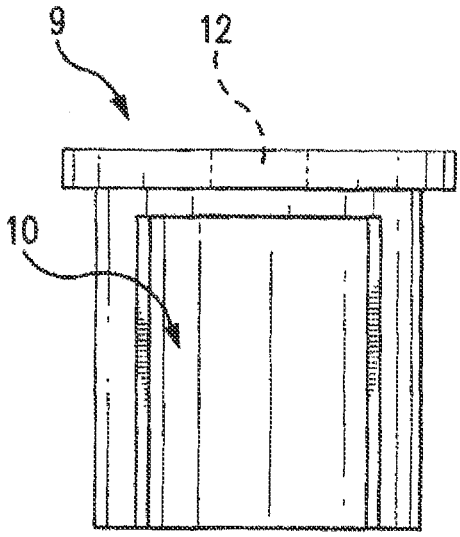
FIG. 6B is a full side view of the shot shell brass component of FIG. 6A with a notch cut into the side.

The kit also contains a shot shell brass component 9 (full view in FIG. 6A) which has a notch 10 cut from the side. (FIG. 6B). Completing the kit is a wood screw 11, the size of which is determined by the size of the primer opening 12 in the shot shell brass 9 shown in FIG. 6A and FIG. 1E, and the need to fasten the shot shell brass 9 to the lower half 1 of the wooden plaque. The wood screw 11 has to have a length longer than the inside depth of the shot shell brass 9 in order to penetrate the lower half 1 of the wooden plaque.

The process for providing a turkey trophy mount of this invention comprises providing a predetermined size of lumber and kind and quality of lumber desired for the plaque, such as maple, mahogany oak, cherry, and the like, which are some of the decorative woods available.

The front 4 and back 3 surfaces of the lumber are planed and then sanded to provide a smooth surface. Obviously, if any cuts are made in the lumber, the edges will also need to be sanded and smoothed. The lumber is then cut into the desired configuration. It should be understood that the steps just described do not have to necessarily be made in the order described.

It should also be noted that contemplated within the scope of this invention to provide sanded, smooth clean plaques, or they may be stained, or coated with a clear coating material, or stained and coated with a clear coating material depending on the desires of the designer.

The back surface 3 is provided with mounting holes 2 (FIG. 1A, line L-L), and the mounting brackets 5 are installed by using adhesive in the openings 2 and inserting the L-shaped ends into said openings 2. The hooped ends 7 and 7' of the mounting brackets are then used to attach the mount to a wall.

Figure 1A:
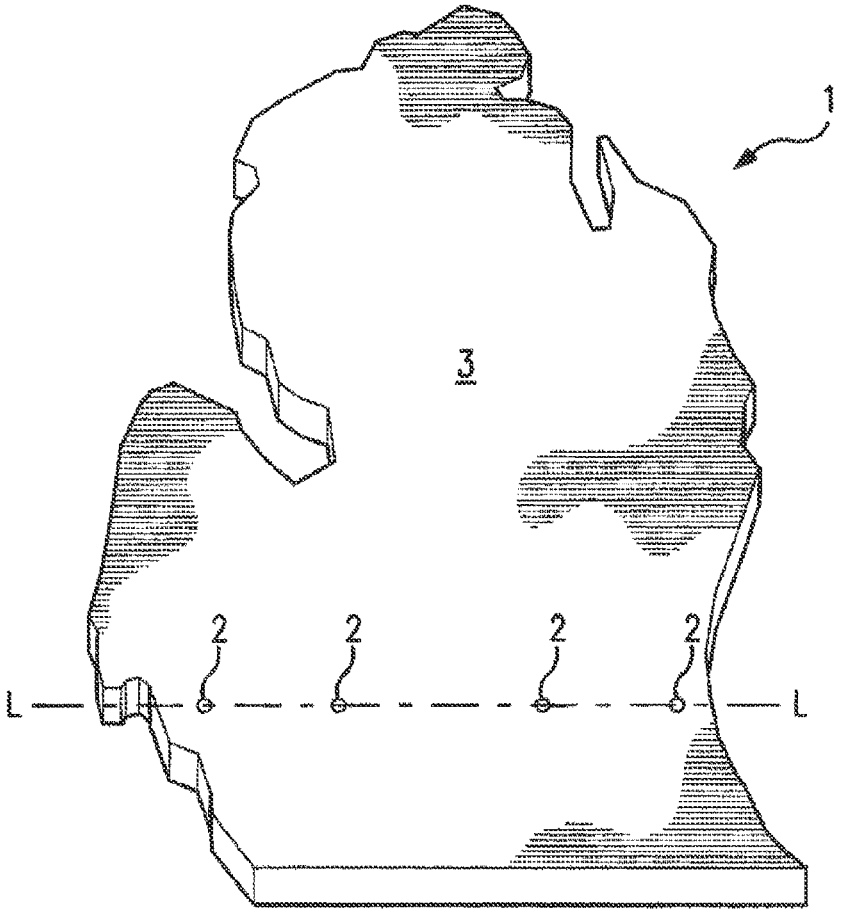
Figure 1B:
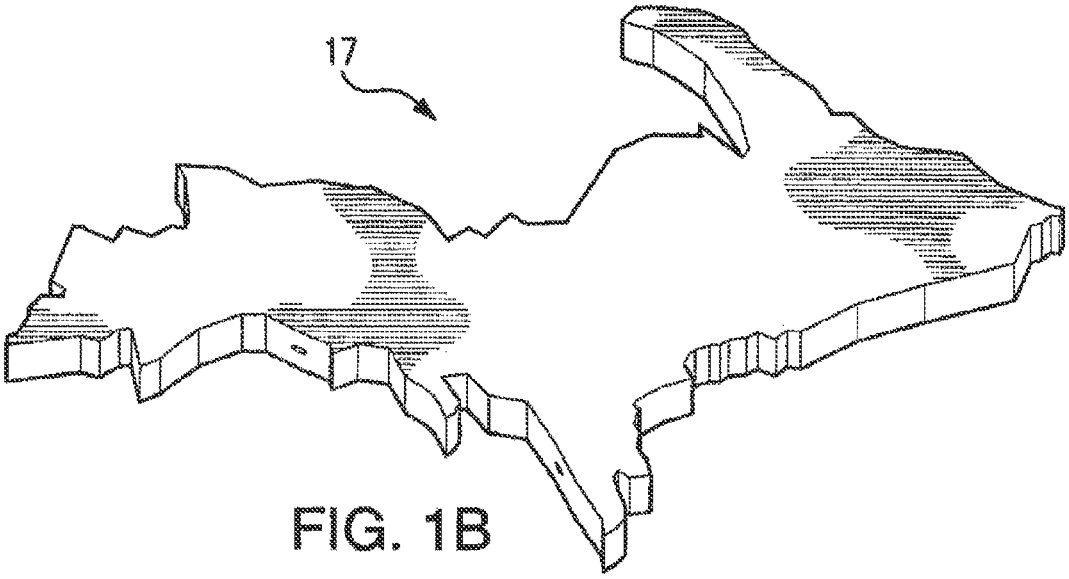
Figure 1C:
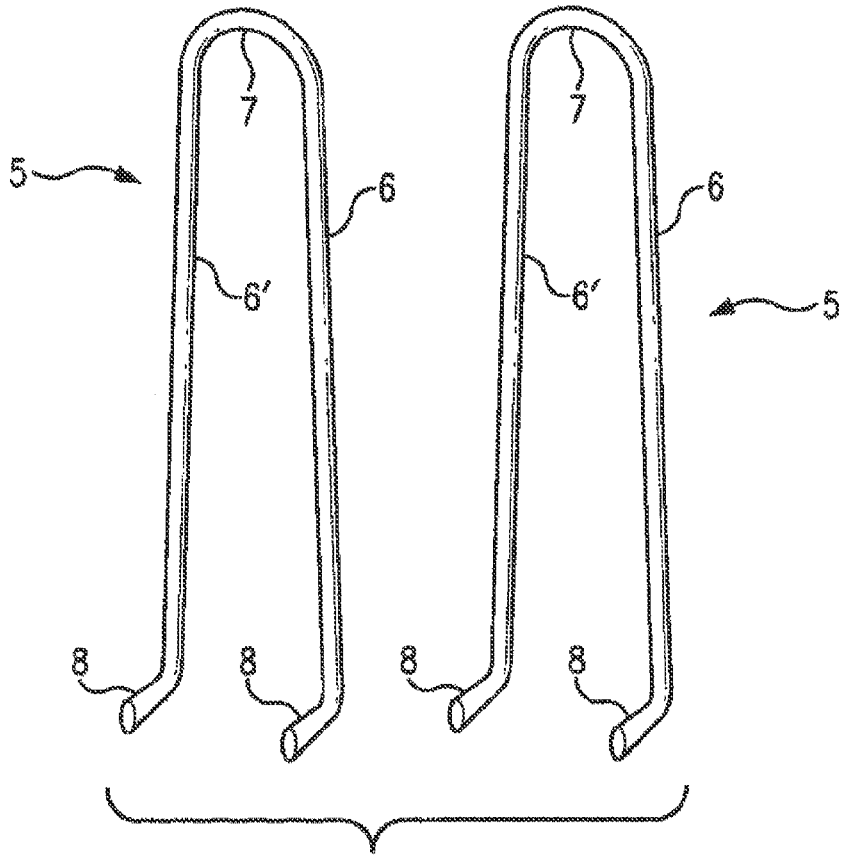
Figure 1D:
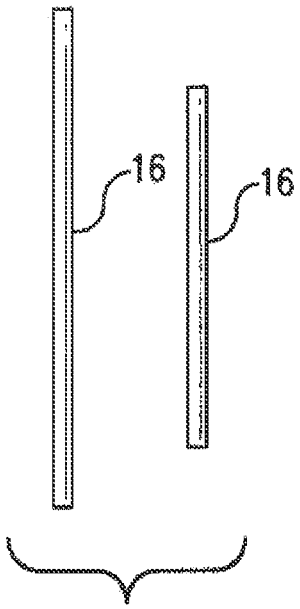
Figure 1E:
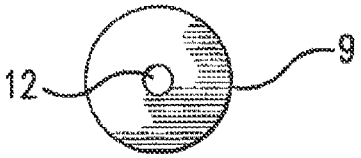
Figure 1F:
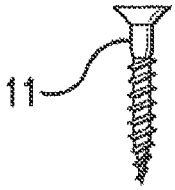
Figure 2:
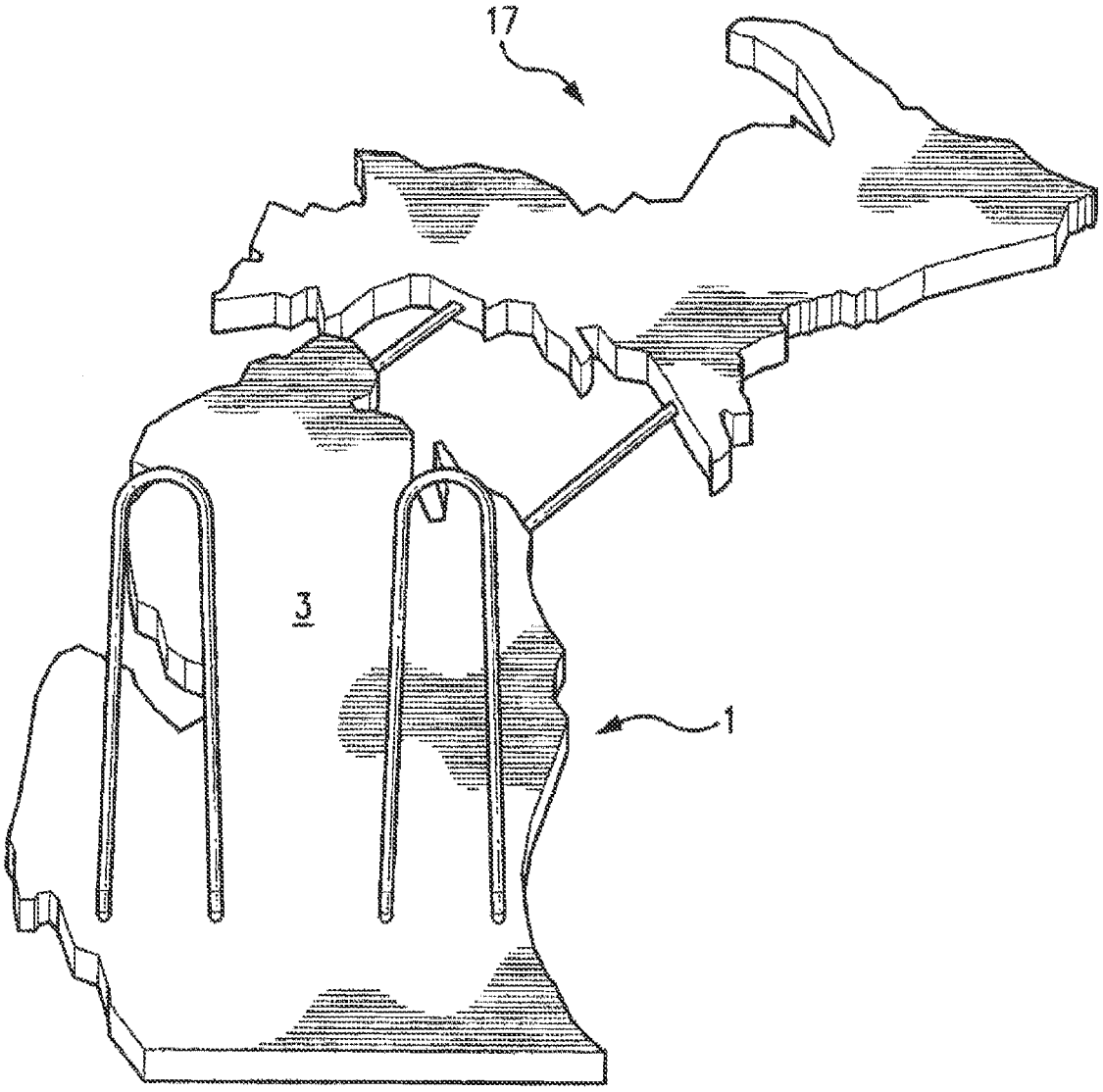
FIG. 2 is a full back view of the plaque configuration.
Figure 3:
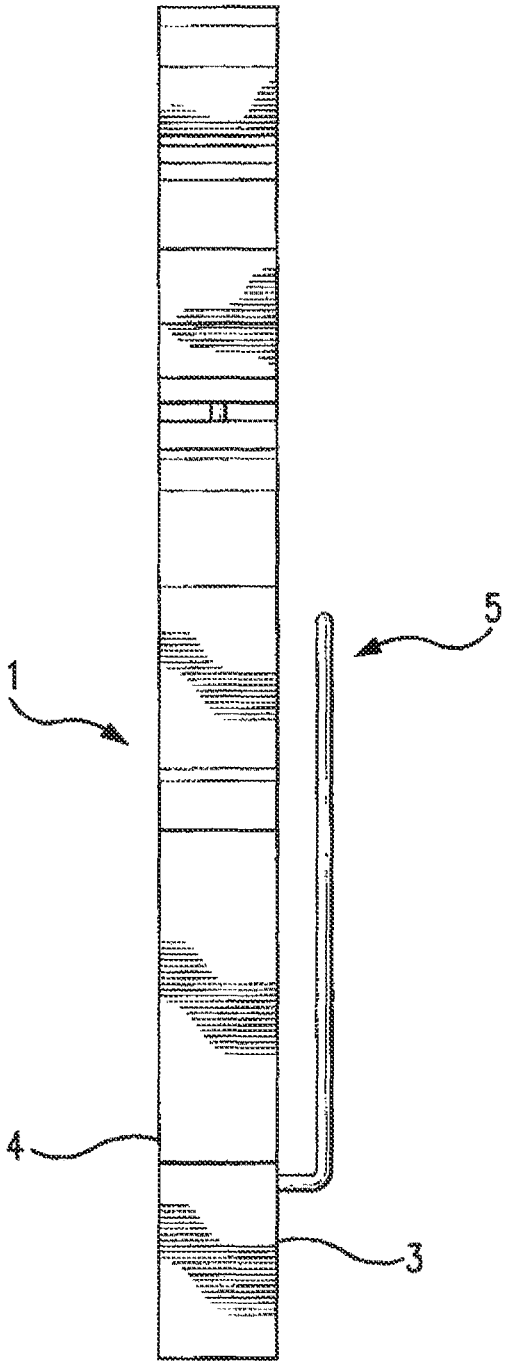
FIG. 3 is a full side view of the plaque configuration.

In the case of the design using the outline of the State of Michigan, there needs to be two additional copper clad steel rods 16 shown in FIG. 1D. These rods 16 are used to support the upper half 17 of the plaque. These rods 16 are optional in the Kit.

Figure 4:
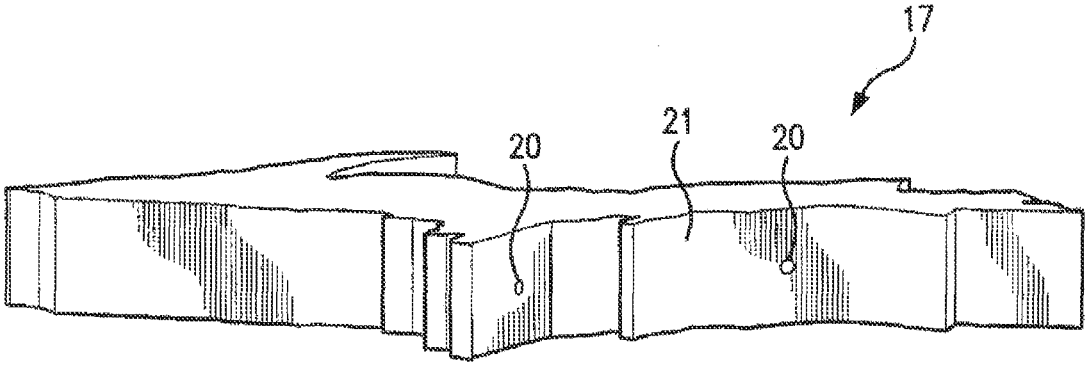
FIG. 4 is a view of the bottom of a portion of the top half of the plaque configuration.
Figure 5:
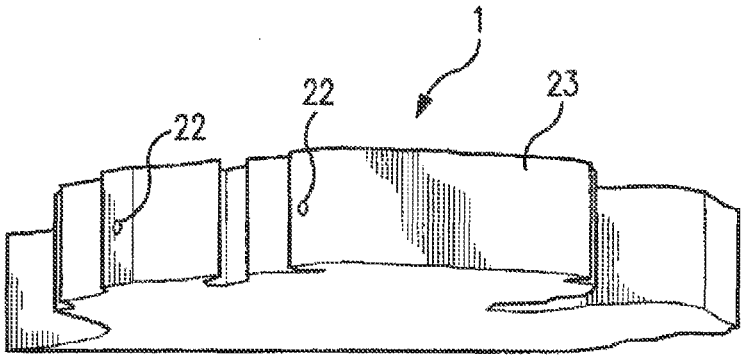
FIG. 5 is a top view of the bottom half of the plaque configuration.

The openings 20 in the bottom 21 of the upper half 17 (FIG. 4) and the openings 22 in the top 23 of the lower half 1 are used by inserting the additional rods 16 therein using adhesive.

A fanned turkey tail 23 (FIG. 7) is then placed in the mounting brackets 5, a turkey beard 18, with a bit of flesh attached thereto is mounted in the shot shell brass component 9 by using the wood screw 11 inserted through the primer opening 12 and into the wood of the lower half 1 of the plaque, on the front surface 4 thereof.

FIG. 7 shows a full front view of the full turkey mount using the mounting kit of this invention. Also shown in this Figure is the addition of a set of spurs 19 from the turkey.

The process of this invention does not necessarily require that the steps of the process be in the order set forth in this specification.

What is claimed is:

1. A turkey trophy mounting kit comprising in combination:

i. a predetermined configured wooden plaque component, said wood plaque component having a back surface, a front surface, and four openings in said back surface, wherein said openings are on the same horizontal line and spaced apart in a predetermined configuration to accept two separate mounting brackets;

ii. each said mounting bracket being copper clad steel rod having two legs and having a diameter from 8 to 12 gauge by Standard Wire Gauge, and from 4 inches to 6 inches in length;

iii. each said mounting bracket having a hooped top end connecting said two legs, said two legs and said hooped top end providing a flat plane, the opposite end of each said leg being configured in an L-shape perpendicular to said plane of said hooped top end and said two legs;

iv. a shot shell brass, said shot shell brass having a predetermined inside depth and a notch in a side thereof;

v. a wood screw having a length approximately equal to said inside depth of said shot shell brass.

2. A turkey trophy mounting kit as claimed in claim 1 wherein, in addition, there are at least two, straight, copper coated steel rods of 8 to 12 gauge by standard Wire Gauge.

3. A turkey trophy mounting kit as claimed in claim 1 wherein the plaque pattern is sanded smooth.

4. A turkey trophy mounting kit as claimed in claim 3 wherein the plaque pattern is stained.

5. A turkey trophy mounting kit as claimed in claim 3 wherein the plaque pattern is coated with a clear coating.

6. A turkey trophy mounting kit as claimed in claim 3 wherein the plaque pattern is stained and coated with a clear coating.

7. A process for providing a turkey trophy mount, said process comprising:

i. providing a predetermined size of lumber having a back surface and a front surface;

ii. planeing said front and back surfaces;

iii. sanding said back and front surfaces and any edge surfaces;

iv. configuring said lumber into a desired plaque pattern;

v. drilling four openings in said back surface wherein said openings are on the same horizontal line and spaced-apart in a predetermined configuration to accept two separate mounting brackets, wherein said mounting brackets are copper clad steel having two legs and being from 8 to 12 gauge by Standard Wire gauge in diameter and from 4 to 6 inches in length, wherein each said mounting bracket has a hooped top end connected between said two legs, wherein said two legs and said hooped top end provide a flat plane, there being an opposite end configured in an L-shape perpendicular to said plane of said hooped top end and said two legs;

vi. installing said mounting brackets in said openings with adhesive;

vii. installing a fanned turkey tail in said mounted brackets;

viii. installing a shot shell brass having a notch in a side thereof using a wood screw inserted through a primer hole in said shot shell brass into said plaque pattern on said front surface, wherein said shot shell brass has been provided with a turkey beard mounted therein.

8. A process as claimed in claim 7 wherein, in addition, there is at least one, straight, copper coated steel rod of 8 to 12 gauge by standard Wire Gauge affixed to said plaque pattern in any desired location.

9. A process as claimed in claim 7 wherein the plaque pattern is sanded smooth.

10. A process as claimed in claim 7 wherein the plaque pattern is stained.

11. A process as claimed in claim 7 wherein the plaque pattern is coated with a clear coating.

12. A process as claimed in claim 7 wherein the plaque pattern is stained and coated with a clear coating.

* * * * *